US005945388A

United States Patent [19]

Cook et al.

[11] Patent Number: 5,945,388

[45] **Date of Patent: *Aug. 31, 1999**

[54] LUBRICATING OIL COMPOSITIONS

[75] Inventors: Stephen J. Cook, North Humberside, United Kingdom; Sean P. O'Connor, Ridgefield, Conn.

[73] Assignee: Lubrizol Adibis Holdings (UK) Ltd., Merseyside, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/436,480

[22] PCT Filed: Aug. 21, 1994

[86] PCT No.: PCT/GB94/02047

§ 371 Date: Apr. 23, 1996

§ 102(e) Date: Apr. 23, 1996

[87] PCT Pub. No.: WO95/08608

PCT Pub. Date: Mar. 30, 1995

[30] Foreign Application Priority Data

Sep. 23, 1993 [GB] United Kingdom ..... 9319648

[51] Int. Cl.[6] ..... C10M 149/00; C10M 133/00

[52] U.S. Cl. ..... 508/556; 508/545; 508/559; 44/412; 44/432; 44/433

[58] Field of Search ..... 508/545, 558, 508/559, 556; 44/433, 412, 432

[56] References Cited

U.S. PATENT DOCUMENTS

| | | | |
|---|---|---|---|
| 3,438,757 | 4/1969 | Honnen et al. . | |
| 3,565,804 | 2/1971 | Honnen et al. | 508/558 |
| 3,755,433 | 8/1973 | Miller et al. . | |
| 3,844,958 | 10/1974 | Anderson et al. . | |
| 5,015,404 | 5/1991 | Kubo et al. . | |

FOREIGN PATENT DOCUMENTS

| | | |
|---|---|---|
| 0 338 311 | 10/1989 | European Pat. Off. . |
| 716979 | 10/1954 | United Kingdom . |
| 973679 | 10/1964 | United Kingdom . |
| 9303126 | 2/1993 | WIPO . |

OTHER PUBLICATIONS

CRC Handbook of Lubrication, vol. I, Application and Maintance, "Medium Speed Engines" & Marine Equipmen, Booser, Ph.D., CRC Press, Inc. Florida, 1983, pp. 74–81 & 227–234.

International Search Report for Application No. PCT/GB94/02047; Date Mailed: Jan. 2, 1995.

MER, Jul. 1996, "Countering 'Black Sludge' and 'Black Paint'", pp. 22–24.

A. Montaud et al., Fifth CEC International Symposium on the Performance Evaluation of Automotive Fuels and Lubricants, May 13–15, 1997, "Effects and Determination of Raw Fuel Dilution in Marine Crankcase Lubricants".

P. Mullins, Technology Review, Diesel & Gas Turbine Worldwide, pp. 44–48, Dec. 1992, "The Changing Scene in Engine Lubrication".

Database WPI, Week 7503, Derwent Publications Ltd., London, GB, AN 75–04013W Oct. 12, 1974.

Database PWI, Week 9230, Derwent Publications Ltd., London, GB, AN 92–242666, Feb. 27, 1992.

*Primary Examiner*—Margaret Medley

*Attorney, Agent, or Firm*—Renner, Otto, Boisselle & Sklar, P.L.L.

[57] ABSTRACT

A lubricating oil composition suitable for use in a low or medium speed diesel engine comprising a fuel oil with a residual oil content is characterised in that the lubricating oil composition further comprises a hydrocarbyl substituted amine or polyamine. The effect of such an amine is to reduce deposits due to the residual oil. A method of reducing deposits in a low or medium speed diesel engine is also disclosed.

9 Claims, No Drawings

LUBRICATING OIL COMPOSITIONS

The present invention relates to lubricating oil compositions and in particular to lubricating oil compositions suitable for medium or low speed diesel engines, typically the four-stroke trunk-piston engine.

Lubricating oils for medium or low speed diesel engines are known and will typically contain a range of additives which will perform a variety of functions, for example they may comprise dispersants to minimise deposit formation in various parts of the engine or detergent additives. However contamination of these lubricating oil compositions with unburnt residual fuel oil is a problem recognised in the industry. This leads to severe engine cleanliness problems in service which is sometimes referred to as "black paint". The problem is particularly widespread in 4-stroke trunk-piston engines where dirty cam boxes and crankcases are encountered. However, the problem is not confined to 4-stroke engines. 2-stroke cross-head engines can also suffer from the problem. These 2-stroke engines will usually use two separate lubricating oils, one for the crankcase and one for the cylinder, but it is in the crankcase where the heavy deposits potentially occur.

It might be expected that the problem would be overcome simply by using more of the conventional dispersant additive in the lubricating oil but this measure has met with very limited success. However, we have now found that the aforementioned problem is solved by including in the lubricating oil compositions a hydrocarbyl-substituted amine or polyamine.

Thus according to the present invention there is provided a lubricating oil composition suitable for use in low or medium speed diesel engines comprising a fuel oil with a residual oil content characterised in that the lubricating oil composition further comprises a hydrocarbyl-substituted amine or polyamine.

The lubricating oil composition of the present invention will be suitable for use in either a low or medium speed engine especially a marine diesel engine. Typically such an engine can be a 4-stroke trunk piston engine having an engine speed of 50–1,000 rpm e.g. 100–500 rpm, and a brake horse-power (BHP) per cylinder of 10–3,000 preferably 250–2,000. The engine can also be a 2-stroke cross-head engine having a speed of 40–1,000 rpm preferably 100–500 rpm and a brake horse-power per cylinder of 100–8,000.

In a further aspect of the present invention there is provided a method of reducing deposits in a low or medium speed diesel engine comprising lubricating the moving parts of the engine with a lubricating oil composition suitable for use in such an engine which comprises a fuel oil with a residual oil content characterised in that the lubricating oil composition further comprises a hydrocarbyl-substituted amine or polyamine.

The lubricating oil compositions of the present invention will have a TBN in the range 0.1 to 100 mgKOH/g. Where the composition is to be used in a 4-stroke trunk piston engine the TBN is preferably in the range 5–70, more preferably 8–50 mgKOH/g; where it is to be used in a 2-stroke cross-head engine and particularly for the crankcase, the TBN of the composition is preferably 0.1 to 15, more preferably 1 to 10 mgKOH/g.

The lubricating oil composition of the present invention will usually be a monograde lubricant i.e. one which exhibits little or no viscosity index improvement properties e.g. an SA30 oil.

As regards the lubricating oil, this may be any oil suitable for the lubrication of a low or medium-speed diesel engine particularly a marine diesel engine. The lubricating oil may suitably be an animal, a vegetable or a mineral oil. Suitably the lubricating oil is a petroleum-derived lubricating oil, such as a naphthenic base, paraffin base or mixed base oil. Alternatively, the lubricating oil may be a synthetic lubricating oil. Suitable synthetic lubricating oils include synthetic ester lubricating oils, which oils include diesters such as di-octyl adipate, di-octyl sebacate and tri-decyl adipate, or polymeric hydrocarbon lubricating oils, for example liquid polyisobutene and poly-alpha olefins. Commonly, a mineral oil is employed. The oil may be suitable for lubricating a low or medium speed marine diesel engine without adjustment of its viscosity. If viscosity adjustment is required it may be achieved by the addition of, for example, bright stock. The lubricating oil will generally comprise greater than 70% by weight, typically greater than 80% by weight of the composition.

The lubricating oil composition will be contaminated with a fuel oil which has a residual oil content. Such a fuel oil will be suitable for use as a diesel fuel oil. Fuel oils can in general be divided into two main categories—distillates and heavy fuels. Distillates consist of one or more distilled fractions. Heavy fuels are fuels which comprise at least a proportion of a residual oil, that is an oil which remains after the distilled fractions have been removed from an unrefined oil. The composition of the residual oil will vary with the composition of the starting oil which is usually a crude oil and will also vary depending upon the distillation conditions. However, by its nature residual oil is of high molecular weight and high boiling point and the man skilled in the art will know what is meant by residual oil. Heavy fuels can also comprise, in addition to residual oil, distillates. The present invention is concerned with lubricating oil compositions that are contaminated with a heavy fuel. The amount of heavy fuel in the lubricating oil composition will vary. Typically the composition will comprise between 0.1 to 25 e.g. 0.1 to 10 especially 0.3 to 5 more especially 0.5 to 3% by weight.

Hydrocarbyl-substituted amines or polyamines useful in the compositions of the invention are well-known in the art, particularly in the art devoted to detergent-containing fuel compositions, such as for example U.S. Pat. No. 3,438,757; U.S. Pat. No. 3,565,804; U.S. Pat. No. 3,574,576; U.S. Pat. No. 3,671,511 and GB-A-1405305. Useful hydrocarbyl-substituted amines are further described in U.S. Pat. No. 4,877,416. Typically, the hydrocarbyl-substituted amines and polyamines are high molecular weight hydrocarbyl N-substituted amines or polyamines containing at least one basic nitrogen. The hydrocarbyl substituent suitably has a molecular weight in the range from about 750 to 10,000, more usually in the range from about 1000 to 5000.

The hydrocarbyl substituent may be aliphatic or alicyclic. It may be branched or unbranched. Preferably the substituent will be derived from a polyolefin, suitably a polyolefin derived from a $C_2$ to $C_{10}$ olefin, for example polyethylene, polypropylene or polyisobutene, preferably polyisobutene. A preferred polyisobutene is a highly reactive polyisobutene.

Monoamines having the formula:

$$\text{R NAX} \qquad \text{(II)}$$

wherein R is a hydrocarbyl substituent as described hereinbefore, and A and X are independently H, hydrocarbyl or hydroxyhydrocarbyl of from 1 to 10 carbon atoms may be used in the composition of the invention.

Suitably A and X are independently either hydrogen or alkyl groups or hydroxyalkyl groups of from 1 to 6 carbon atoms, preferably of from 1 to 3 carbon atoms. Alternatively, A and X are taken together with the nitrogen to which they are attached to form a ring having five or six members, which may be substituted with an oxygen atom to form, for example morpholine. Illustrative amines having the formula (II) include polypropenyl amine, polyisobutenyl amine, N-polyisobutenyl dimethylamine, N-polyisobutenyl methylethylamine, N-polyisobutenyl morpholine, and the like.

A suitable amine for use in the composition of the invention is that described in GB-A-1405305, i.e. one having the formula:

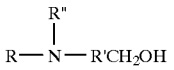

(III)

wherein R is derived from a polyolefin as described hereinbefore,

R' is an amino-substituted hydrocarbylene group, and

R" is H or a $C_1$ to $C_4$ alkyl group.

Also suitable are hydrocarbyl-substituted polyalkylenepolyamines of the formula:

$$R_1NH(R_2NH)_aH \quad (IV)$$

wherein $R_1$ is a hydrocarbyl group as hereinbefore described, $R_2$ is an alkylene group having from 2 to 6 carbon atoms, and a is an integer of from 0 to 10.

Preferably with regard to the polyamine of formula (IV) $R_2$ is $C_2$ or $C_3$ alkylene and a is an integer of from 1 to 6.

The hydrocarbyl-substituted amine or polyamine may suitably be prepared by chlorinating a polyolefin and thereafter reacting the chlorinated polyolefin with the amine. A process for effecting this is described in, for example U.S. Pat. No. 3,671,511.

Alternatively, the polyolefin may be oxidised to introduce carbonyl functional groups, for example in the manner described in EP-A-271261, i.e. by passing through a column of the polyisobutene maintained at a temperature in the range from 140 to 200° C. a molecular oxygen-containing gaseous oxidant at a gas flow rate greater than 20 litres $cm^{-2}h^{-1}$ measured at the operating pressure, and thereafter aminated, for example in the manner described in EP-A-382405 i.e. by reacting the carbonyl functionalised polyisobutene [PIB]-(CO)R and an amine $H_2NR^1$ and hydrogenating the product of the reaction between the carbonyl functionalised polyisobutene and the amine, where:

PIB=a polyisobutenyl group,

R=H, methyl or vinyl, $R^1$=a $C_1$–$C_{20}$ alkyl group or $—(CHR^2)_n[X(CH_2)_m]_pX'R^3$ wherein $R^2$=H or methyl, n=an integer of from 1 to 4, m=an integer of from 2 to 4, p=o, or an integer of from 1 to 10, X, $X^1$=O or $NR^4$ where $R^4$=H, a $C_1$–$C_{10}$ alkyl group or $[(CH_2)_qX^2R^5]$ where q=an integer of from 2 to 4, $R^5$=H or a $C_1$–$C_{10}$ alkyl group, $X^2$=O or NH, each of X and $X^1$ may be the same or different and when p>1 each of the repeating units $[X(CH_2)_m)$ may be the same or different.

In a further alternative the carbonyl functionalised polyisobutene may be obtained by epoxidising a polyisobutene and reacting the epoxide so-obtained.

Suitably the amount of the hydrocarbyl-substituted amine or polyamine in the composition is at least 0.01%, preferably at least 0.05%, more preferably at least 0.10% by weight of the composition.

In addition to the lubricating oil and the hydrocarbyl-substituted amine or polyamine the composition of the invention may contain other additives, chief amongst which is a dispersant.

Although any type of dispersant may be employed in the composition, a suitable dispersant is one derived from a hydrocarbyl-substituted succinic acid or anhydride by reaction with an amine i.e. a hydrocarbyl-substituted succinimide e.g. a PIB succinimide. Such succinimides are well known in the art.

Succinimide production is described in, for example, U.S. Pat. No. 2,992,708; U.S. Pat. No. 3,018,291; U.S. Pat. No. 3,024,237; U.S. Pat. No. 3,100,673; U.S. Pat. No. 3,219,666; U.S. Pat. No. 3,172,892 and U.S. Pat. No. 3,272,746.

Succinimide dispersants which are mono- or bis- succinimides may be employed.

The amount of dispersant present in the low or medium speed diesel engine lubricating oil composition of the present invention may suitably be in the range from 0.01 to 5.0, preferably from 0.1 to 2.5% by weight based on the weight of the composition.

A preferred composition according to the present invention comprises from 0 to 5.0%, preferably from 0.10% to 3.0% of a hydrocarbyl-substituted succinimide dispersant, from 0.05 to 5.0%, preferably from 0.10% to 3.0% of a hydrocarbyl-substituted amine or polyamine and comprising the remainder of the composition a low or medium-speed diesel engine lubricating oil.

In addition to the foregoing the composition may additionally contain additives conventionally employed in low or medium speed diesel engine lubricating oil compositions. Examples of such additives include detergents, foam inhibitors, extreme pressure/antiwear agents, rust inhibitors, antioxidants, and the like. Detergents generally employed in the compositions of the invention include hydrocarbyl-substituted alkaline earth metal phenates, salicylates, naphthenates, sulphonates or carboxylates, which may be normal or overbased materials. The detergent, in addition to providing detergency, is generally employed to adjust the total base number of the composition to a desired value, typically about 30 mg KOH/g.

The composition of the invention may be prepared by diluting a concentrate comprising a solution of the hydrocarbyl-substituted amine or polyamine and optionally the other additives referred to hereinbefore in a suitable carrier with low or medium-speed diesel engine lubricating oil. As the carrier there may be employed any solvent for the amine which is compatible both with the lubricating oil and with the use of the composition. The carrier may be any inert hydrocarbon solvent. The hydrocarbyl-substituted amine or polyamine may suitably be present in the concentrate in an amount in the range from 0.1 to 20% by weight.

The invention will now be further illustrated by reference to the following examples. In the examples the total sediment content of residual fuel contaminated compounded oils is determined.

In the test method, ten grams of the test oil which has previously been subjected to ageing at 100° C. for 24 hr is filtered through a filter medium. After solvent washing and drying the total sediment on the filter medium is weighed. The test is carried out in duplicate.

Results

The mass percentage of Total Sediment to the nearest 0.01% m/m is calculated using:

$$S = \frac{M1 - M2}{M3} \times 100$$

where S=Total Sediment in % m/m

M1=Mass of filter medium after filtration in g

M2=Mass of filter medium before filtration in g

M3=Mass of sample filtered in g.

In the Examples which follow reference will be made to products identified by the abbreviations A–F. These correspond to the following products:

A a 60:40 solution of polyisobutene (PIB) amine derived from the reaction of a PIB having a number average molecular weight of about 1300 and aminoethylethanolamine in an aromatic hydrocarbon solvent.

B As A except that the PIB has a number average molecular weight of about 1000 ["B actives" is B which does not contain any aromatic hydrocarbon solvent].

C a bis-succinimide-type detergent ex. Adibis.

D A 9 TBN additive core package containing detergent, an anti-wear agent and dispersant.

E a booster additive pack containing some dispersant and detergent for use in combination with D to increase its TBN to 30.

F a succinimide-type dispersant ex Adibis.

In the following Comparison Tests and Examples all percentages are percentages by weight.

Comparison Test 1

A commercial medium-speed diesel engine lubricating oil [SAE 40 grade] formulation "X" containing C and respectively 10% and 20% residual fuel (an 85:15 combination of hydrocracked and fuel oils) were tested in the Adibis Test Method for "black paint".

The results of the test are given in the accompanying Table 1.

EXAMPLE 1

Comparison Test 1 was repeated except that 10% of C was replaced by "B actives".

EXAMPLE 2

Comparison Test 1 was repeated except that 20% of C was replaced by "B actives".

The results are given in Table 1.

TABLE 1

| Example | S (% m/m) | |
|---|---|---|
| | 10% Residual Fuel | 20% Residual Fuel |
| Comparison Test 1 | 0.091 | 0.187 |
| 1 | 0.061 | 0.129 |
| 2 | 0.043 | 0.103 |

It can be seen from Table 1 that replacement of a portion of the succinimide dispersant by hydrocarbyl amine leads to a marked reduction in sediment.

Comparison Test 2

A commercial formulation "Y" containing C was tested.

EXAMPLE 3

Comparison Test 2 was repeated except that 15% of C was replaced by "B actives".

EXAMPLE 4

Comparison Test 2 was repeated except that 25% of C was replaced by "B actives".

EXAMPLE 5

Comparison Test 2 was repeated except that 50% of C was replaced by "B actives".

EXAMPLE 6

Comparison Test 2 was repeated except that 75% of C was replaced by "B actives".

The results of Comparison Test 2 and Examples 3 to 6 are given in Table 2.

TABLE 2

| Example | S (% m/m) | |
|---|---|---|
| | 10% Residual Fuel | 20% Residual Fuel |
| Comparison Test 2 | 0.103 | 0.517 |
| 3 | 0.098 | 0.116 |
| 4 | 0.074 | 0.088 |
| 5 | 0.061 | 0.077 |
| 6 | 0.052 | 0.063 |

Comparison Test 3

Comparison Test 2 was repeated except that a different residual fuel (RF) was employed.

Comparison Test 4 and 5

Comparison Test 2 was repeated except that C was replaced by a different succinimide dispersant.

EXAMPLE 7

Comparison Test 3 was repeated except that C was replaced by A.

The results of Comparison Tests 3–5 and Example 7 are given in Table 3.

TABLE 3

| Example | S (% m/m) | |
|---|---|---|
| | 10% Residual Fuel | 20% Residual Fuel |
| Comparison Test 3 | 1.24 | 2.61 |
| Test 4 | 1.34 | 2.58 |
| Test 5 | 1.05 | 1.90 |
| 7 | 0.80 | 0.97 |

Comparison Test 6

Comparison Test 2 was repeated except that a different residual fuel (RF) was employed.

EXAMPLE 8

Comparison Test 6 was repeated except that 25% C was replaced by "B actives".

EXAMPLE 9

Comparison Test 6 was repeated except that 50% C was replaced by "B actives".

EXAMPLE 10

Comparison Test 6 was repeated except that 75% C was replaced by "B actives".

EXAMPLE 11

Comparison Test 6 was repeated except that 100% C was replaced by "B actives".

The results of Comparison Test 6 and Examples 8 to 11 are given in Table 4.

TABLE 4

| Example | S (% m/m) 10% Residual Fuel | S (% m/m) 20X Residual Fuel |
|---|---|---|
| Comparison Test 6 | 0.085 | 0.414 |
| 8 | 0.050 | 0.074 |
| 9 | 0.051 | 0.063 |
| 10 | 0.047 | 0.060 |
| 11 | 0.022 | 0.054 |

Comparison Test 7

Comparison Test 2 was repeated using a different sample of the same lubricating oil (SAE 40 grade) using same residual fuel.

Comparison Test 8

Comparison Test 7 was repeated except that the amount of C in the formulation was increased by the addition of a further 0.5% in fuel oil.

Comparison Test 9

Comparison Test 7 was repeated except that the amount of C in the formulation was increased by the addition of a further 1.0% in fuel oil.

The results of Comparison Tests 7–9 are given in Table 5.

TABLE 5

| Example | S (% m/m) 10% Residual Fuel | S (% m/m) 20% Residual Fuel |
|---|---|---|
| Comparison Test 7 | 1.38 | 2.73 |
| 8 | 1.24 | 2.40 |
| 9 | 1.10 | 2.12 |

The results in Table 5 demonstrate that increasing the amount of a succinimide-type dispersant in the composition does not have a marked effect upon sedimentation, and hence "black paint".

We claim:

1. A low or medium speed two stroke or four stroke diesel engine lubricating oil composition comprising:

a low or medium speed two stroke or four stroke diesel engine lubricating oil contaminated with a heavy fuel having between 0.5 and 3% by weight of a residual oil content; and an effective amount of a hydrocarbyl-substituted amine or polyamine to reduce deposits resulting from contamination of such lubricating oil composition with said heavy fuel.

2. A lubricating oil composition as claimed in claim 1, wherein the hydrocarbyl amine has a hydrocarbyl substituent having a molecular weight in the range of 1000 to 5000 and is derived from polyisobutene.

3. A lubricating oil composition as claimed in claim 1 wherein the amine has the formula III

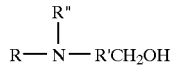

III wherein R is derived from a polyolefin,

R' is an amino-substituted hydrocarbylene group and

R" is H or a $C_1$ to $C_4$ alkyl group.

4. A lubricating oil composition as claimed in claim 1 wherein the polyamine is of the formula IV $$R_1NH(R_2NH)_aH \quad \text{IV}$$

wherein $R_1$ is a hydrocarbyl group $R_2$ is an alkylene group having from 2 to 6 carbon atoms, and a is an integer of from 1 to 10.

5. A lubricating oil composition as claimed in claim 1 wherein the amount of hydrocarbyl-substituted amine or polyamine in the composition is at least 0.10% by weight of the composition.

6. A lubricating oil composition as claimed in claim 1 wherein the lubricating oil composition is a monograde lubricant.

7. A method of reducing deposits in a low or medium speed two stroke or four stroke diesel engine, said method comprising lubricating the moving parts of the engine with a lubricating oil composition which comprises a low or medium speed two stroke or four stroke lubricating oil contaminated with a heavy fuel having between 0.5 and 3% by weight of a residual oil content, and an effective amount of a hydrocarbyl-substituted amine or polyamine to reduce deposits resulting from the contamination of said lubricating oil composition with said heavy fuel.

8. A method of reducing deposits in a low or medium speed diesel engine as claimed in claim 7 wherein the engine is a 4-stroke piston engine.

9. A method of reducing deposits in a low or medium speed diesel engine as claimed in claim 7 wherein the engine is a 2-stroke cross-head engine.

* * * * *